US010590592B2

(12) United States Patent
Lee et al.

(10) Patent No.: US 10,590,592 B2
(45) Date of Patent: Mar. 17, 2020

(54) CLOTHES DRYER

(71) Applicant: LG Electronics Inc., Seoul (KR)

(72) Inventors: Manseok Lee, Seoul (KR); Junseok Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 139 days.

(21) Appl. No.: 15/835,730

(22) Filed: Dec. 8, 2017

(65) Prior Publication Data

US 2018/0163340 A1 Jun. 14, 2018

(30) Foreign Application Priority Data

Dec. 9, 2016 (KR) ..... 10-2016-0167931

(51) Int. Cl.

| | |
|---|---|
| ***D06F 58/20*** | (2006.01) |
| ***D06F 58/10*** | (2006.01) |
| ***D06F 58/02*** | (2006.01) |
| ***D06F 39/12*** | (2006.01) |

(52) U.S. Cl.

CPC ..... *D06F 58/20* (2013.01); *D06F 58/10* (2013.01); *D06F 39/12* (2013.01); *D06F 58/02* (2013.01); *D06F 58/206* (2013.01)

(58) Field of Classification Search

CPC ..... D06F 58/20; D06F 58/10; D06F 39/12; D06F 58/206; D06F 58/02

See application file for complete search history.

(56) References Cited

U.S. PATENT DOCUMENTS

| | | | | |
|---|---|---|---|---|
| 2009/0260248 | A1 | 10/2009 | Prajescu et al. | |
| 2010/0155039 | A1* | 6/2010 | Ediger | D06F 58/28 165/138 |
| 2016/0053426 | A1* | 2/2016 | Kasapoglu | D06F 58/20 34/86 |

FOREIGN PATENT DOCUMENTS

| | | | |
|---|---|---|---|
| EP | 1865103 | A1 | 12/2007 |
| EP | 2199454 | A1 | 6/2010 |
| WO | WO2014154251 | A1 | 10/2014 |

OTHER PUBLICATIONS

European Extended Search Report in European Application No. 17205863.8, dated Apr. 20 2018, 9 pages.

* cited by examiner

*Primary Examiner* — Jessica Yuen
(74) *Attorney, Agent, or Firm* — Fish & Richardson P.C.

(57) ABSTRACT

A clothes dryer of the present invention includes: a casing having an inner space, and a ventilation part for allowing the inner space to communicate with an external space; a drum disposed in the casing on a circulation flow path where an air flow circulates; a heat pump, which has a compressor for circulating a refrigerant along a refrigerant pipe, absorbs heat from air discharged from the drum during circulation of the refrigerant, and by using the absorbed heat, heats air to be supplied into the drum along the circulation flow path; a cooling fan, which is disposed in the casing, and cools the compressor by introducing outside air into the casing through the ventilation part; and a sound-insulating cover connected with the casing, wherein the sound-insulating cover is spaced apart from the ventilation part so that the outside air is introduced into the casing through the ventilation part, and has a sound-insulating plate which is disposed to overlap with at least a portion of the ventilation part when viewed from a front of the ventilation part.

13 Claims, 7 Drawing Sheets

CLOTHES DRYER

CROSS-REFERENCE TO RELATED APPLICATION

This application claims the priority benefit of Korean Patent Application No. 10-2016-0167931, filed on Dec. 9, 2016 in the Korean Intellectual Property Office, the disclosure of which is incorporated herein by reference.

BACKGROUND OF THE INVENTION

1. Field of the Invention

The present disclosure relates to a clothes dryer having a sound insulating cover to reduce noise emanating from a ventilation part.

2. Description of the Related Art

Generally, a clothes dryer is a device for drying clothes by supplying hot air into a drum where wet clothes are introduced. The clothes dryer may be classified into a vented dryer and a condenser dryer according to a method of processing moist air discharged from the drum after clothes are dried.

In the vented dryer, clothes are dried by hot air heated by a heater and supplied into a drum, and moist air discharged from the drum is discharged to the outside of the dryer. The drying method does not require any separate condenser for condensing moisture, since the moisture removed from the clothes is discharged along with air to the outside of the dryer.

In the condenser dryer, air heated by a heater circulates along a circulation flow path formed to allow the heated air to pass through a drum, and moisture contained in the air is condensed or removed during the circulation process.

A heat pump, which heats the circulating air by collecting heat discharged from the drum, is used as the heater (i.e., air heating device). The heat pump includes a compressor for compressing a refrigerant. Such clothes dryer is provided with a cooling fan for cooling the compressor when the compressor is overheated.

The cooling fan is used to suction outside air (air outside of the clothes dryer), and a casing, which forms an exterior of the clothes dryer, has a ventilation port through which outside air is introduced when the cooling fan operates. However, such conventional clothes dryer has a problem in that noise, generated during the operation of the compressor, is released to the outside through the ventilation port.

SUMMARY OF THE INVENTION

It is a first object of the present invention to provide a clothes dryer in which noise may be reduced.

It is a second object of the present invention to provide a clothes dryer in which noise may be reduced while securing a sufficient amount of outside air for cooling a compressor included in a heat pump.

It is a third object of the present invention to provide a method of preventing overheating and/or reducing noise without degrading performance of the clothes dryer.

It is a fourth object of the present invention to provide a clothes dryer having a soundproofing or a sound-absorbing structure for absorbing high frequency noise generated during the operation of a compressor.

It is a fifth object of the present invention to provide a clothes dryer in which a sound-absorbing material which is not attached to a compressor, but is provided at the side of a ventilation port of a casing that is formed to cool the compressor. In this manner, even when the sound-absorbing material is disposed, a sufficient amount of outside air introduced through the ventilation port may be secured.

According to the present invention, a clothes dryer, comprises a casing having an inner space, and a ventilation part for allowing the inner space to communicate with an external space, a drum disposed in the casing on a circulation flow path, a heat pump with a compressor for circulating a refrigerant along a refrigerant pipe, the heat pump absorbing heat from air discharged from the drum during circulation of the refrigerant, and heating, by using the absorbed heat, air to be supplied into the drum along the circulation flow path, a cooling fan, which is disposed in the casing for cooling the compressor by introducing outside air into the casing through the ventilation part, and a sound-insulating cover which is connected with the casing and spaced apart from the ventilation part so that the outside air is introduced into the casing through the ventilation part, and has a sound-insulating plate which is disposed to overlap with at least a portion of the ventilation part when looking at the ventilation part from the rear of the dryer.

The sound-insulating cover may further comprise a sound-insulating plate supporter which extends from the sound-insulating plate toward the casing to be connected with the casing, so that the sound-insulating plate is fixed at a position spaced apart from the ventilation part. The sound-insulating plate supporter may comprise a supporting part extending a predetermined length from the sound insulating plate to the casing to define a space between the sound-insulating plate and the casing, and a connection part which is bent from the supporting part to be disposed side by side with one surface of the casing having the ventilation part. The connection part may be bent from the supporting part in a direction away from the ventilation part. The connection part may have a hole through which a fastening member coupled with the casing passes.

The clothes dryer may further comprise a sound-absorbing material which is fixed at the sound-insulating cover, so as to be disposed between the sound-insulating plate and the ventilation part. The sound-insulating plate may have at least one air passage opening for outside air, in a region where the sound-insulating plate overlaps with the ventilation part and the sound-absorbing material may be fixed below the air passage opening. The sound-insulating cover may further comprise at least one hook which protrudes from one surface of the sound-insulating plate that faces the ventilation part, and fixes the sound-absorbing material.

The at least one hook may comprise a horizontal part which extends horizontally from the sound-insulating plate toward the ventilation part, and a vertical part which is bent from the horizontal part to extend downward, and the sound-absorbing material may be interposed between the vertical part and the sound-insulating plate.

The sound-insulating plate may have a first through-hole. When viewed from a front of the first through-hole, an entire vertical part of the hook may be viewed through the first through-hole.

The sound-insulating plate may comprise a flat plate part which has one surface facing the ventilation part and a side part which is bent from a circumference of the flat plate part and extends toward the ventilation part. The sound-insulating cover may further comprise a sound-absorbing material which is made of a porous material and is disposed in a concave space formed by the flat plate part and the side part.

The sound-insulating cover may further comprise a horizontal fixing tap which protrudes from the side part in a transverse direction. The sound-absorbing material may be fixed between the horizontal fixing tap and the flat plate part. The sound-insulating cover may have a second through-hole which is formed to enable an entire horizontal fixing tap to be viewed through the second through-hole when viewed from a rear of the sound-insulating plate.

The sound-insulating cover may further comprise one or more vertical fixing tap which protrudes upward from the side part. The sound-absorbing material may be fixed between the one or more vertical fixing tap and the flat plate part. The sound-insulating cover may further comprise a third through-hole which is formed to enable an entire vertical fixing tap to be viewed through the third through-hole when viewed from the rear of the sound-insulating plate.

The sound-insulating cover may further comprise a hook which protrudes from the flat plate part, and fixes the sound-absorbing material.

The sound-insulating plate may comprise at least one air passage opening for outside air, in a region where the sound-insulating plate overlaps with the ventilation part. The clothes dryer may further comprise a sound-absorbing material which is fixed at the sound-insulating cover, so as to be disposed between the sound-insulating plate and the ventilation part.

The sound-insulating plate may comprise at least one air passage opening for outside air, in a region where the sound-insulating plate overlaps with the ventilation part. A total area, obtained by adding an outside air inlet area, formed between an outer circumference portion of the sound-insulating plate and the casing, and an area of the at least one air passage opening, is twice to 2.5 times an outside air inlet area formed by the ventilation part. The ventilation part is provided at a rear surface of the casing.

Alternatively according to the present invention, a clothes dryer comprises a casing having an inner space, and a ventilation part for allowing the inner space to communicate with an external space, a drum disposed in the casing on a circulation flow path where an air flow circulates, a heat pump that comprises an evaporator for absorbing heat from an air flow discharged from the drum, a compressor for compressing a refrigerant after passing through the evaporator, and a condenser for heat-exchanging the refrigerant, compressed by the compressor, with the air flow supplied into the drum, a cooling fan, which is disposed in the casing, and cools the compressor by introducing outside air into the casing through the ventilation part, and a sound-insulating cover, which comprises a sound-insulating plate with one surface facing the ventilation part, and a sound-insulating plate supporter extending from the sound-insulating plate to be connected with the casing, so that the sound-insulating plate is spaced apart from the ventilation part.

DETAILED DESCRIPTION OF THE PREFERRED EMBODIMENTS

Advantages and features of the present invention and a method of achieving the same will be more clearly understood from embodiments described below with reference to the accompanying drawings. However, the present invention is not limited to the following embodiments but may be implemented in various different forms. The embodiments are provided merely to complete disclosure of the present invention and to fully provide a person having ordinary skill in the art to which the present invention pertains with the category of the invention. The invention is defined only by the category of the claims. Wherever possible, the same reference numbers will be used throughout the specification to refer to the same or like parts.

Figure 1:
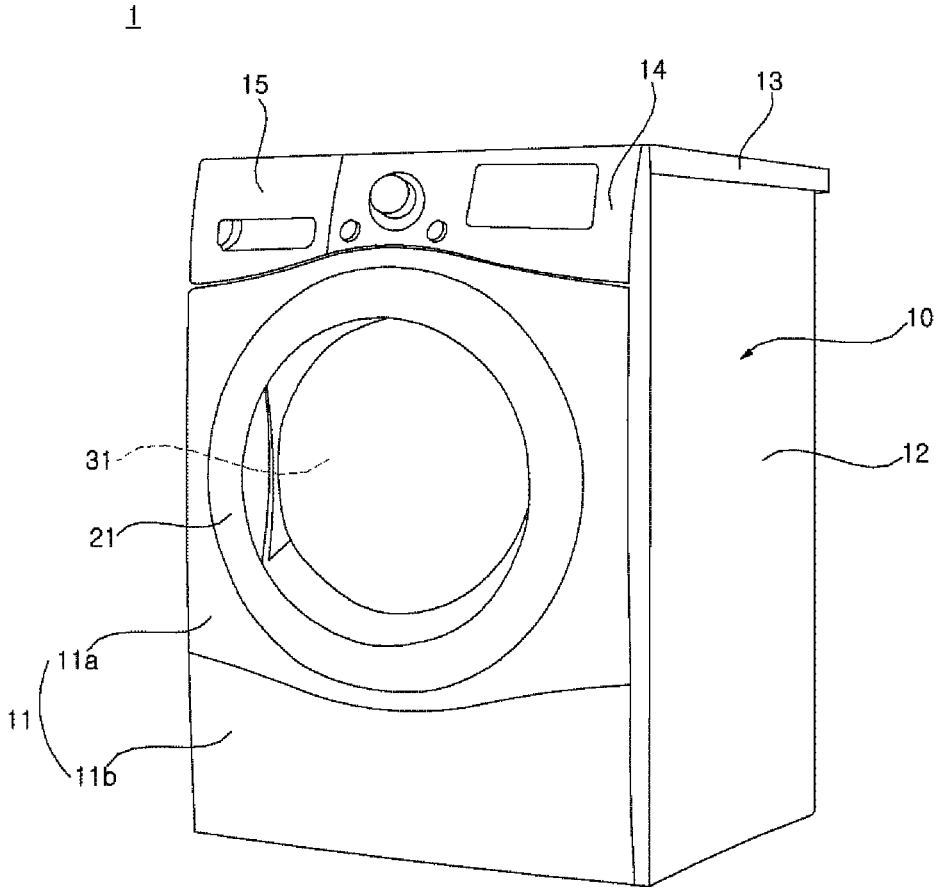
FIG. 1 is a perspective view of a clothes dryer according to an embodiment of the present invention.
Figure 2:
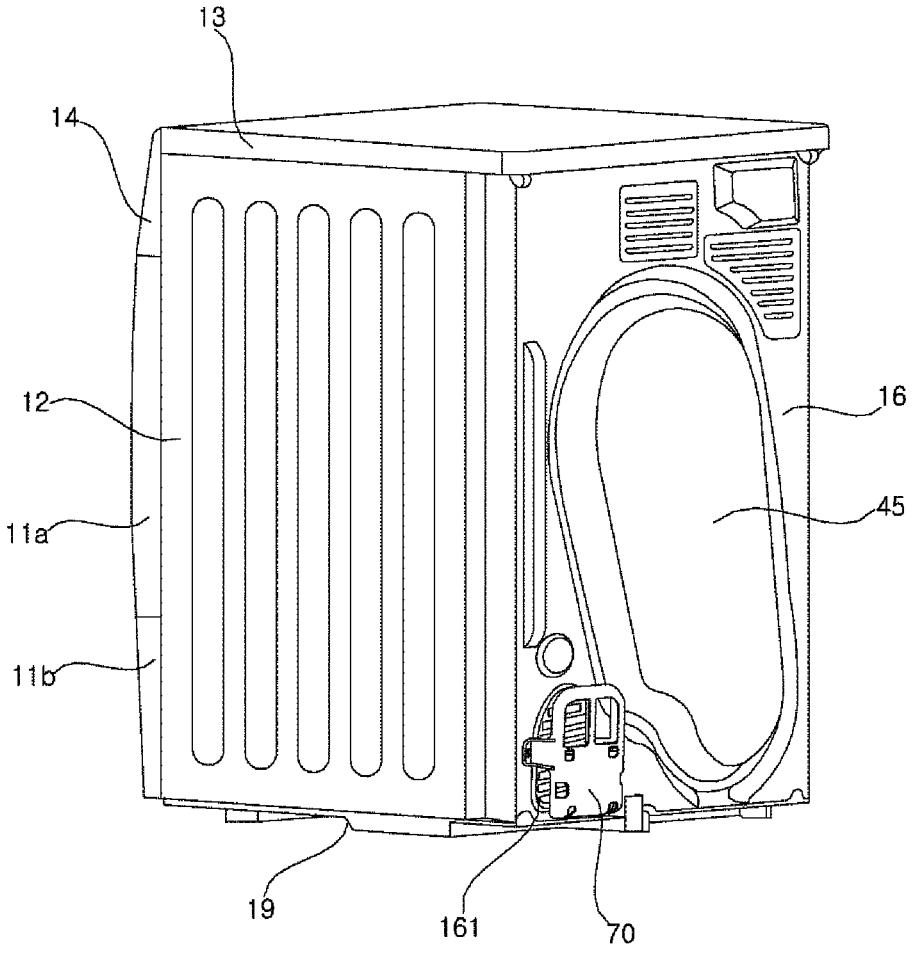
FIG. 2 is a perspective view illustrating a rear side of the clothes dryer of FIG. 1.
Figure 3:
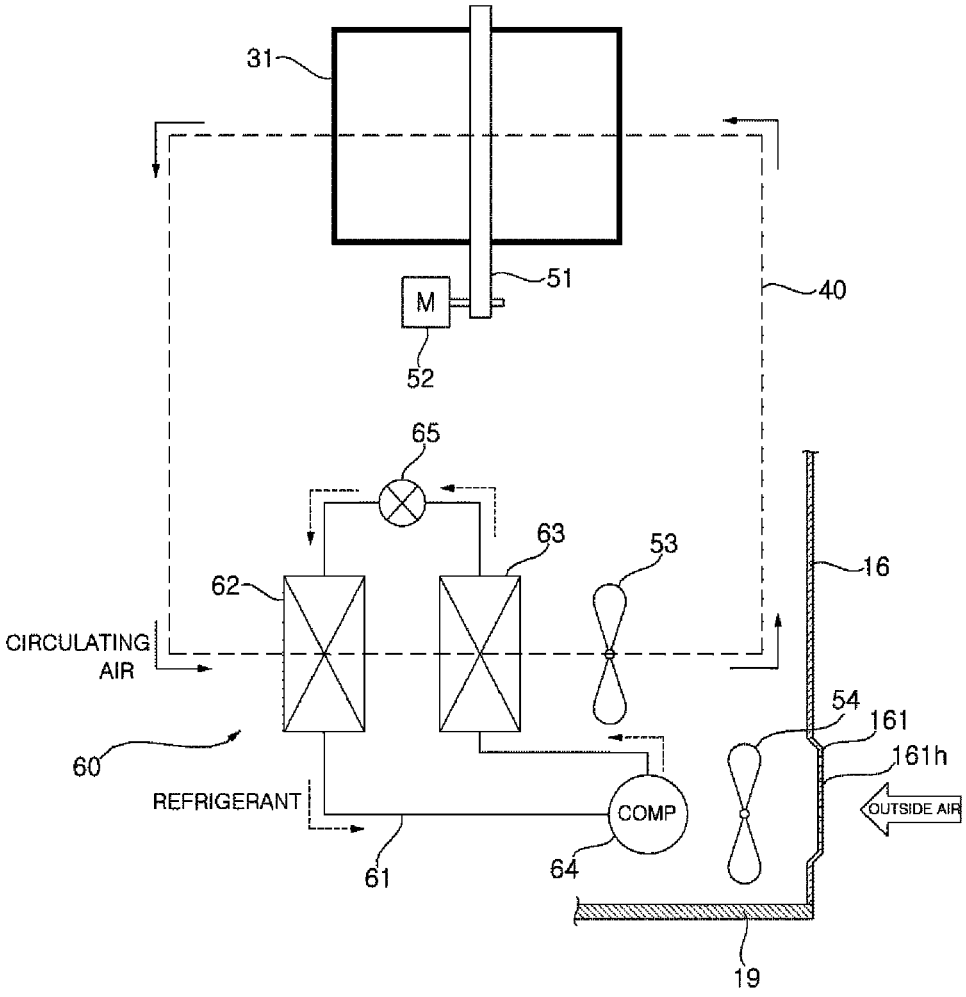
FIG. 3 is a view illustrating main parts of a clothes dryer according to an embodiment of the present invention.

FIG. 1 is a perspective view of a clothes dryer according to an embodiment of the present invention. FIG. 2 is a perspective view illustrating a rear side of the clothes dryer of FIG. 1. FIG. 3 is a view illustrating main parts of a clothes dryer according to an embodiment of the present invention. Hereinafter, the clothes dryer 1 according to an embodiment of the present invention will be described with reference to FIGS. 1 to 3.

A casing 10 forms an exterior of the clothes dryer 1. An introduction opening, through which clothes are introduced, may be formed on a front surface of the casing 10, and a door 21, which opens and closes the introduction opening, may be rotatably connected to the casing 10.

The casing 10 may include a front panel 11, a right panel 12, a left panel (which is not shown, but is formed on an opposite side of the right panel 12), and a rear panel 16, which respectively form a front side, a left side, a right side, and a rear side of the clothes dryer. In addition, the casing 10 may further include a base 19 which is substantially horizontal and supports the panels, and a top plate 13 which is substantially horizontal and is connected to the top of the panels.

The front panel 11 may include an upper panel 11*a* on which the introduction opening is formed, and a lower panel 11*b* which is disposed below the upper panel 11*a*. The door has an approximately circular shape, and is rotatably connected to the upper panel 11*a*, to open and close the introduction opening by operation of a user.

A control panel 14 may be disposed above the front panel 11. The control panel 14 may include a display (e.g., LCD panel, LED panel, etc.) which displays an operating state of the clothes dryer, and an input part (e.g., button, dial, touch screen, etc.) which receives input of operation commands for operating the clothes dryer from a user.

A water tank 15 may be provided at one side of the control panel 14 to be withdrawable therefrom. Condensed water generated during a drying process is collected in the water tank 15. A user may pull out the water tank 15 and may drain the condensed water collected therein.

The casing 10 may include a ventilation part 161 which enables an inner space of the casing 10 to communicate with an external space. The ventilation part 161 may have at least one ventilation port. The ventilation part 161 may be provided at a rear surface (for example, at the rear panel 16) of the casing 10. In the embodiment, the ventilation part 161 is formed in a grille shape having a plurality of slots 161*h* corresponding to the ventilation port, but is not limited thereto.

The ventilation part 161 may be integrally formed with the casing 10. In the embodiment, the ventilation part 16 is integrally formed with the rear panel 16.

A drum 31 may be rotatably disposed in the casing 10. A motor 52 may be disposed in the casing to rotate the drum 31. The drum 31 has a cylindrical shape with a front surface and a rear surface that are open, in which the open front surface communicates with the introduction opening formed at the front panel 11, and the open rear surface may be opened and closed by a supporter (not shown) which rotatably supports the drum 31.

A lifter (not shown), which extends lengthwise in a longitudinal direction, may be disposed on an inner circumference of the drum 31. The lifter protrudes inward of the drum 31, and a plurality of lifters may be disposed at regular intervals along the circumference of the drum 31. During rotation of the drum 31, clothes are lifted and dropped repeatedly by the lifter.

A belt 51 may be wound around an outer circumference of the drum 31. A pulley (not shown), with which the belt 51 is engaged, may be connected to a rotation axis of the motor 52. However, the method of rotating the drum 31 is not limited thereto. For example, the drum 31 may have an open front surface and a closed rear surface, and the rotation axis may be connected to a rear surface of the drum 31 so that the rotation axis of the motor 52 and the center of rotation of the drum 31 may be arranged on the same line. This method is generally applied to a washer-dryer.

A heater for heating air, and a blower fan 53 for blowing high-temperature air heated by the heater, may be provided in the casing 10. Further, a circulation flow path 40 for guiding circulation of an air flow after passing through the drum 31 may also be provided in the casing 10. The air blown by the blower fan 53 is transferred along the circulation flow path 40. A drying duct 45 is a part of the circulation flow path 40, and may be connected to the rear panel 16 of the casing 10. The air blown by the blower fan 53 is transferred through the drying duct 45 to be supplied into the drum 31.

The clothes dryer 1 may include a heat pump 60. The heat pump 60 absorbs heat from air discharged from the drum 31 during circulation of refrigerant, and heats air supplied into the drum 31 by using the absorbed heat. The heat pump 60 may include an evaporator 62, a compressor 64, an expansion valve 65, and a condenser 63 which are connected by a refrigerant pipe 61, through which the refrigerant as a working fluid circulates.

The evaporator 62 is a heat-exchanger including a fine-diameter tube connected with the refrigerant pipe 61, and heat-conductive heat-transfer plates for heat transfer between the tube and the heat-transfer plates. The evaporator 62 is provided on the circulation flow path 40 to absorb heat from the circulating air. The refrigerant is evaporated in such a manner that the evaporator 62 absorbs heat from an air flow discharged from the drum 31 (i.e., air discharged from the drum 31 after absorbing moisture from clothes in the drum 31), and the absorbed heat is transferred to the refrigerant in the tube.

The moist air may be condensed while passing through the evaporator 62. A condensed water discharge device (not shown) for discharging condensed water from the circulation flow path 40 may be further included. The condensed water discharged by the condensed water discharge device may be collected in the water tank 15.

The compressor 64 compresses the refrigerant after passing through the evaporator 62. The compressor 64 may be an inverter compressor, of which the number of revolutions (or compression capacity) may be changed, but is not limited thereto. The compression capacity of the inverter compressor may be varied by controlling the number of revolutions, such that a heating value of the condenser 63 may be controlled. The inverter compressor uses DC power as a power source. To this end, a driver (not shown), which converts AC power into DC power for conversion to a target frequency, may be further included.

A cooling fan 54 for cooling the compressor 64 may be included in the casing 10. The cooling fan 54 may generate a suction force to suction outside air through the ventilation part 161. A controller (not shown) for controlling operation of the compressor 64 and the cooling fan 54, and a sensor (not shown) for sensing overheating of the compressor 64 may be provided. The sensor may be a temperature sensor which directly senses the temperature of the compressor 64, but is not limited thereto. For example, the sensor may be a pressure sensor which senses discharge pressure of the compressor 64, in which case the controller determines overheating of the compressor 64 based on an output value of the pressure sensor. And upon determining that the compressor 64 is overheated, the controller may control the cooling fan 54 to operate.

The condenser 63 may substantially have the same configuration as the evaporator 62, but serves to condense the refrigerant on the contrary to the evaporator 62. That is, the refrigerant compressed by the compressor 64 is condensed while passing through the condenser 63, and heat is released to the outside during this process.

The condenser 63 is disposed downstream from the evaporator 62 on the circulation flow path 40. The air, of which humidity is lowered while passing through the evaporator 62, is then heated while passing through the condenser 63. The condenser 63 serves as a heater to heat the circulated air.

A refrigerant circulation cycle is formed in such a manner that after the heat of the refrigerant is taken away by the circulating air while the refrigerant passes through the condenser 63, the refrigerant is expanded while passing through the expansion valve 65, and is introduced again into the evaporator 62.

Figure 4:
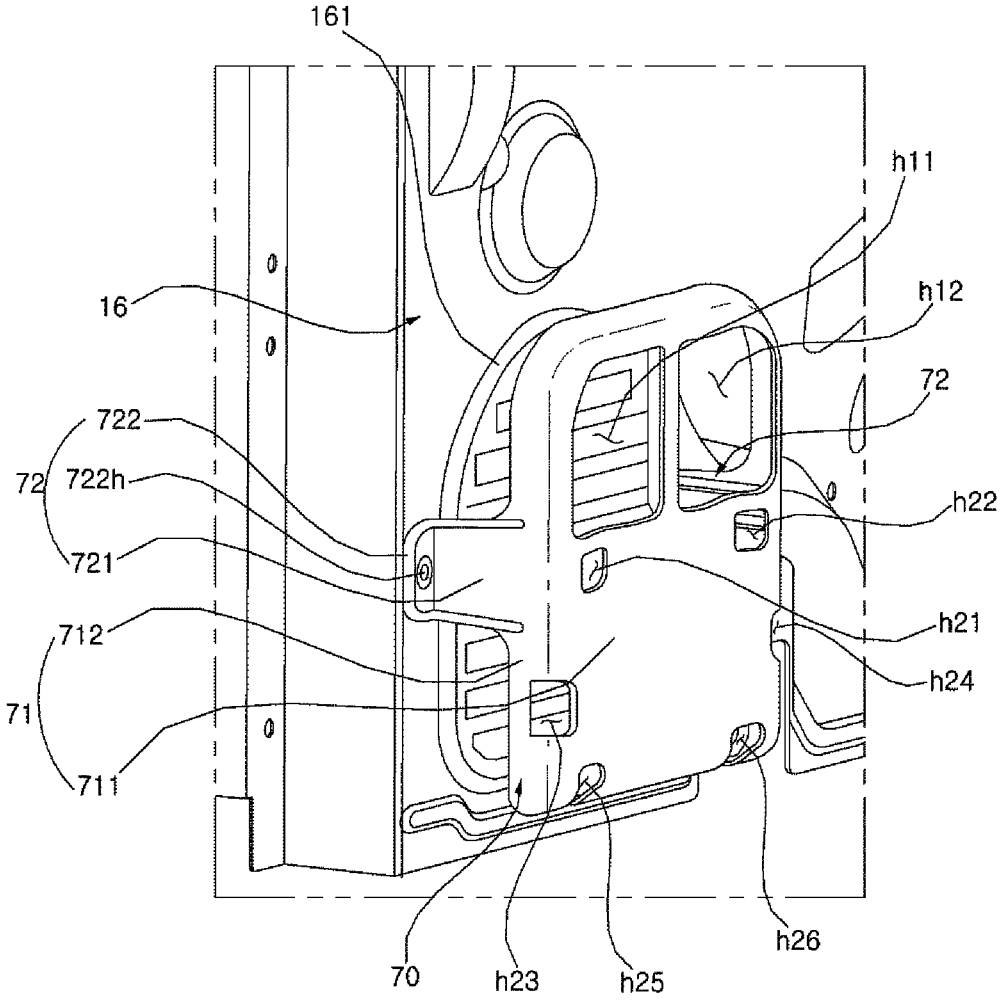
FIG. 4 is an enlarged view illustrating a sound-insulating cover connected to a casing.
Figure 5:
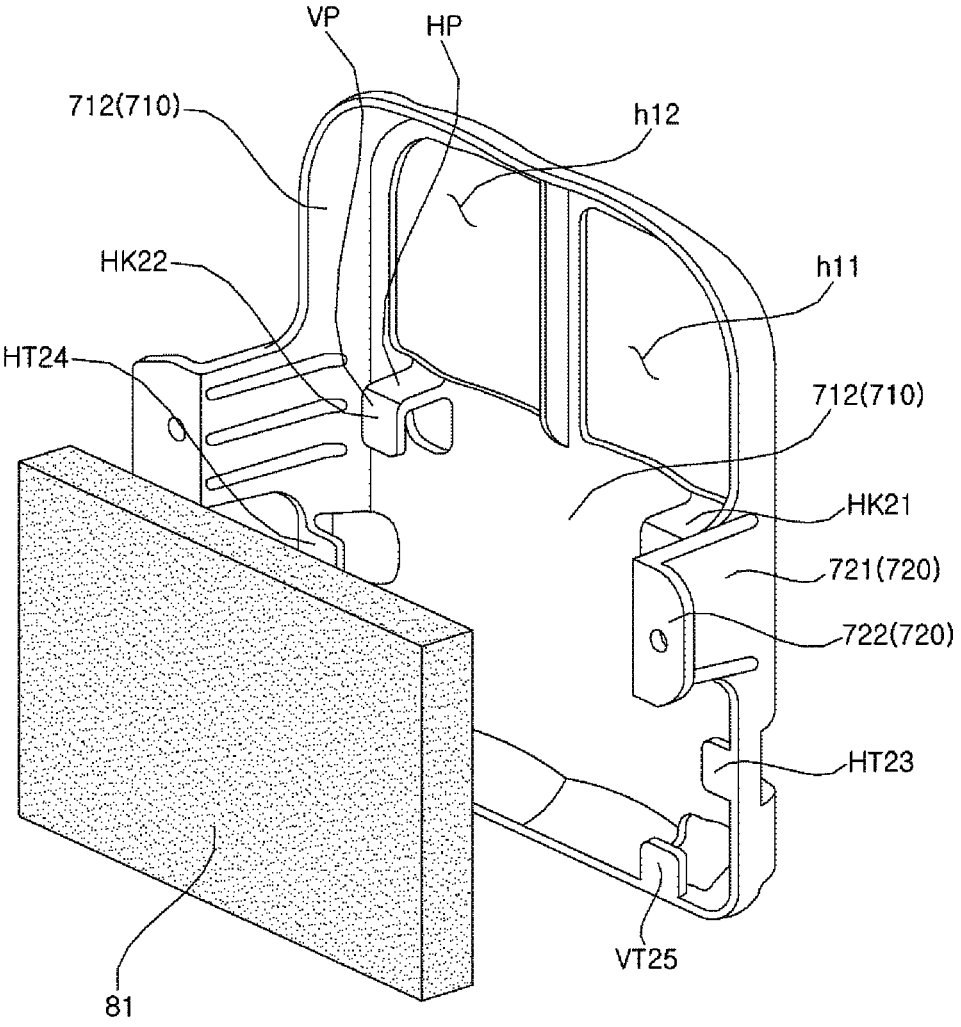
FIG. 5 is a view of a sound-insulating cover and a sound-absorbing material.

FIG. 4 is an enlarged view illustrating a sound-insulating cover 70 connected to a casing 10. FIG. 5 is a view of a sound-insulating cover 70 and a sound-absorbing material 81.

The clothes dryer 1 may include the sound-insulating cover 70 which is connected with the casing 10. The sound-insulating cover 70 may block noise, which is generated during the operation of the compressor 64 and the like, and is released to the outside through the ventilation slot 161*h*, thereby reducing noise. The sound-insulating cover 70 may be connected with the rear panel 16. Hereinafter, description will be made based on an example where the ventilation part 161 is provided at the rear panel 16.

The sound-insulating cover 70 includes a sound insulating plate 71. The sound insulating plate 71 is spaced apart from the ventilation part 161 so that air may be introduced into the casing 10 through the ventilation part 161. When looking at the ventilation part 161 in front (i.e. viewing from rear of the dryer), the sound-insulating plate 71 is disposed to overlap with at least a portion of the ventilation part 161. Since outside air may be introduced through a space between the sound-insulating plate 71 and the ventilation part 161, an amount of air flow introduced by the cooling fan 54 may be secured. That is, while securing the amount of air flow introduced through the ventilation slot 161*h*, the sound-insulating cover 70 may reduce noise released through the ventilation slot 161*h*.

The sound-insulating cover 70 may further include a sound-insulating plate supporter 72 which extends from the sound-insulating plate 71 toward the casing 10 (e.g., the rear panel 16) to be connected with the casing 10 (e.g., the rear panel 16), so that the sound-insulating plate 71 may be fixed at a position spaced apart from the ventilation part 161.

The sound-insulating plate supporter 72 includes a supporting part 721 which extends from the sound-insulating plate 71, and a connection part 722 which is bent from the supporting part 721 to be disposed side by side with one surface of the casing 10 having the ventilation part 161. The connection part 722 may be connected with the casing 10 by a fastening member such as screws and bolts.

The length of the supporting part 721 corresponds to a distance between the sound-insulating plate 71 and the casing 10, and accordingly, an amount of air flow introduced through a space between the sound-insulating plate 71 and the casing 10 is determined according to the length of the supporting part 721.

The connection part 722 may be bent from the supporting part 721 in a direction away from the ventilation part 161 (or laterally). The connection part 722 may be provided with a hole 722*h*, through which a fastening member coupled with the casing 10 may pass.

Referring to FIG. 5, a sound-absorbing material 81 may be further provided between the sound-insulating plate 71 and the ventilation part 161. The sound-absorbing member 81 may be made of a porous material, and may use synthetic resin as such material, but is not limited thereto. The sound-absorbing material 81 may be made of a compressible material capable of being deformed to some extent.

The sound-insulating plate 71 may be provided with at least one air passage opening h11 and h12, through which outside air passes, in a region where the sound-insulating plate 71 overlaps with the ventilation part 161. It is desired that a total area, obtained by adding an outside air inlet area (i.e., an inlet area formed by a space between the sound-insulating plate 71 and the rear panel 16), which is formed between a periphery of the sound-insulating plate 71 and the casing 10, and an area of the at least one air passage opening h11 and h12, is equal to or more than twice an outside air inlet area formed by the ventilation part 161. That is, even when the sound-insulating cover 71 is mounted, a sufficient amount of air flow introduced through the ventilation part 161 may be secured, such that an effect on cooling performance of the compressor 64 may be reduced.

The air passage openings h11 and h12 are provided at a region that is not covered by the sound-absorbing material 81, and is desired to be formed above a region where the sound-absorbing material 81 is fixed.

As the entire area of the at least one air passage opening h11 and h12 becomes larger, an amount of suctioned air is increased, but a sound-insulating effect is reduced, such that it is required to set the size of the air passage openings appropriately, and the entire area is desired not to exceed half the area of a flat plate part 711.

The sound-absorbing material 81 may be fixed below the air passage openings h11 and h12. The sound-insulating cover 70 may be provided with hooks HK21 and HK22 to fix the sound-absorbing material 81. The hooks HK21 and HK22 may include a horizontal part (HP) which extends horizontally from the sound-insulating plate 71 toward the ventilation part 161, and a vertical part (VP) which is bent from the horizontal part (HP) to extend downward. The sound-absorbing material 81 may be interposed between the vertical part (VP) and the sound-insulating plate 71. That is, the horizontal part (HP) extends to a length corresponding to a thickness of the sound-absorbing material 81, and may be fixed with the sound-absorbing material 81 being interposed between the vertical part (VP) and the sound-insulating plate 71.

The sound-insulating plate 71 may have first through-holes h21 and h22. When looking at the first through-holes h21 and h22 in front, the position and shape of the first through-holes h21 and h22 may be configured in a manner that enables the entire vertical part VP of the hooks HK21 and HK22 to be viewed through the first through-holes h21 and h22. In the case where the sound-insulating cover 70 is integrally formed with the sound-insulating plate 71 by injection molding, the configuration allows the mold to be smoothly drawn out through the first through-holes h21 and h22, thereby enabling easy formation of the mold.

The sound-insulating plate 71 may include a flat plate part 711 having one surface facing the ventilation part 161, and a side part 712 which is bent from a circumference of the flat plate part 711, and extends toward the ventilation part 161. The side part 712 may extend along the entire circumference of the sound-insulating plate 71.

The sound-absorbing material 81 may be disposed in a concave space formed by the flat plate part 711 and the side part 712. The hooks HK21 and HK22 may be formed at the flat plate part 711.

The sound-insulating cover 70 may further include at least one horizontal fixing tap HT23 and HT24 which protrudes from the side part 712 in a transverse direction. The sound-absorbing material 81 may be fixed between the horizontal fixing taps HT23 and HT24 and the flat plate part 711. The horizontal fixing taps HT23 and HT24 may be disposed below the hooks HK21 and HK22.

There may be a plurality of horizontal fixing taps HT23 and HT24. In the embodiment, a pair of horizontal fixing taps HT23 and HT24 is provided at portions forming a left side and a right side of the sound-insulating cover 70 on an outer circumference portion of the side part 712, and the pair of horizontal fixing taps HT23 and HT24 protrudes in a mutually facing direction.

When viewed from the rear of the sound-insulating plate 71, the sound-insulating cover 70 may have second through-holes h23 and h24 which are configured in a manner that enables the entire horizontal fixing taps HT23 and HT 24 to be viewed therethrough. The second through-holes h23 and h24 may not only secure an amount of air introduced through the ventilation part 161, but may also form a passage through which a mold is drawn out during injection molding of the horizontal fixing taps HT23 and HT24, in the same manner as the above-described first through-holes h21 and h22.

The sound-insulating cover 70 may further include at least one vertical fixing tap VT25 (although not illustrated, the vertical fixing tap is also provided on a left portion of the sound-insulating cover 70 in FIG. 5), which protrudes upward from the side part 712. The sound-absorbing material 81 may be fixed between the vertical fixing tap VT25 and the flat plate part 711. The vertical fixing tap VT25 may be disposed below the horizontal fixing taps HT23 and HT24.

There may be a plurality of vertical fixing taps VT25. In the embodiment, a pair of vertical fixing taps VT25 is provided at a portion forming a bottom surface of the sound-insulating cover 70 on an outer circumference portion of the side part 712.

When viewed from the rear of the sound-insulating plate 71 (i.e. viewing from rear of the dryer), the sound-insulating cover 70 may have third through-holes h25 and h26 which are configured in a manner that enables the entire vertical fixing taps VT25 to be viewed therethrough. The third through-holes h25 and h26 may not only secure an amount of air introduced through the ventilation part 161, but may also form a passage through which a mold is drawn out during injection molding of the vertical fixing tap VT25, in the same manner as the above-described first through-holes h21 and h22.

Figure 6:
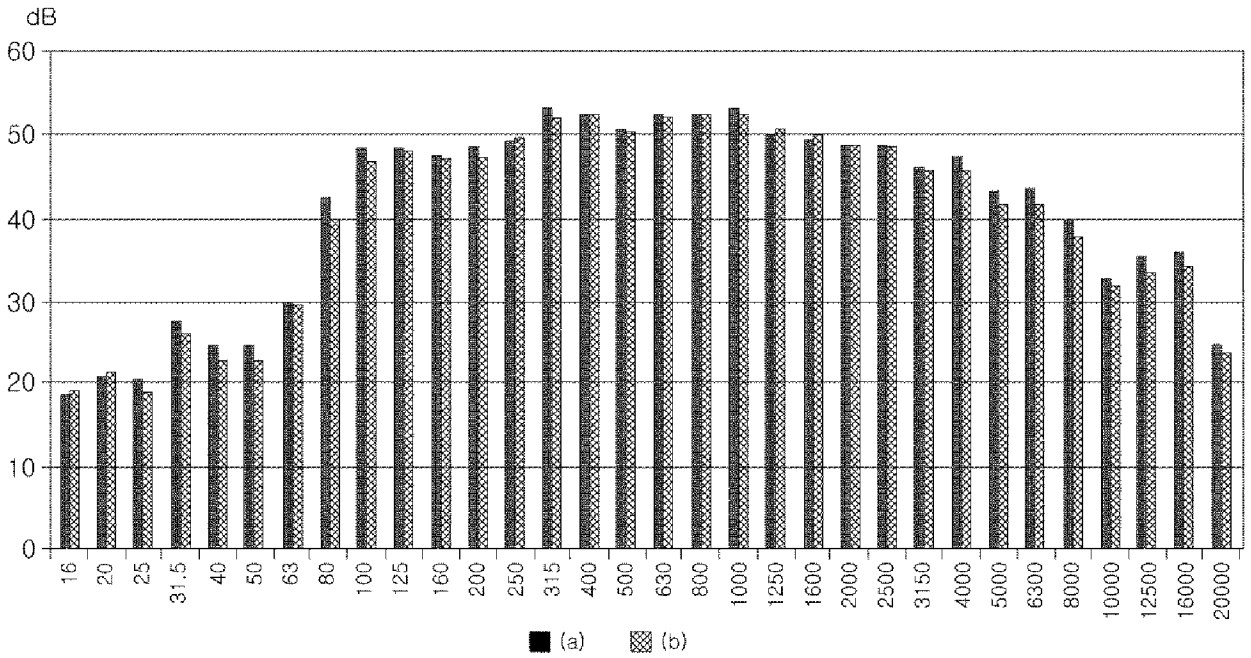
FIG. 6 is a graph showing a noise amplitude (Y axis) relative a noise frequency (X axis) measured while varying the number of revolutions of a compressor, and illustrating a comparison of a case (a) where a sound-insulating cover and a sound-absorbing material are not applied and a case (b) where a sound-insulating cover and a sound-absorbing material are applied.

FIG. 6 is a graph showing a noise amplitude (Y axis) relative to a noise frequency (X axis) measured while varying the number of revolutions of the compressor 64, and illustrating a comparison of a case (a) where the sound-insulating cover 70 and the sound-absorbing material 81 are not applied and a case (b) where the sound-insulating cover 70 and the sound-absorbing material 81 are applied.

Referring to FIG. 6, in the case (b) where the sound-insulating cover 70 and the sound-absorbing material 81 are applied, it can be seen that noise is reduced by approximately 0.4 dB to 2 dB in a high frequency range of 4000 hz or higher.

Figure 7:
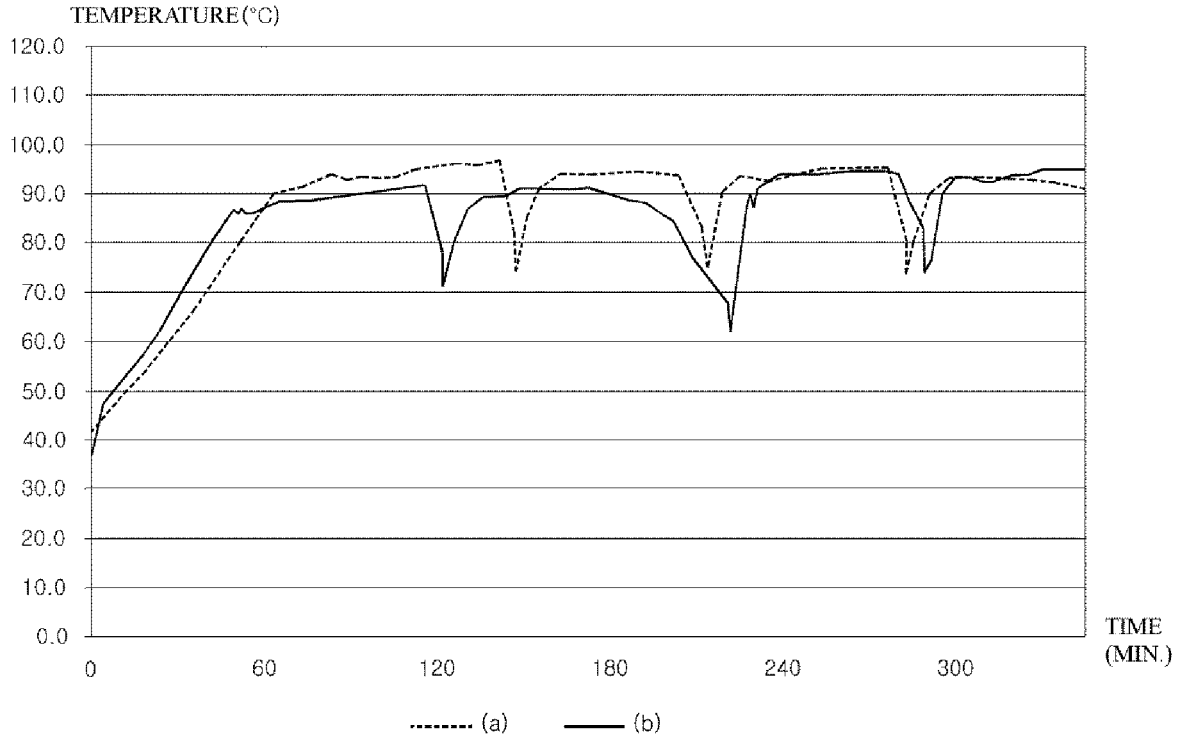
FIG. 7 is a view illustrating a change in temperature of a compressor according to time by comparing a case (a) where a sound-insulating cover and a sound-absorbing material are not applied and a case (b) where a sound-insulating cover and a sound-absorbing material are applied.

FIG. 7 is a view illustrating a change in temperature of the compressor 64 according to time by comparing a case (a) where the sound-insulating cover 70 and the sound-absorbing material 81 are not applied and a case (b) where the sound-insulating cover 70 and the sound-absorbing material 81 are applied.

Referring to FIG. 7, when drying is performed while controlling a maximum temperature of the compressor 64 not to exceed 110 degrees Celsius (maximum allowed temperature for safety), it can be seen that there is no substantial difference in the maximum temperature of the compressor 64 between the case (a) where the sound-insulating cover 70 and the sound-absorbing material 81 are not applied and a case (b) where the sound-insulating cover 70 and the sound-absorbing material 81 are applied (96.5 degrees Celsius in the case (a) and 95 degrees Celsius in the case (b)). That is, as shown in the graph of FIG. 7, even when the sound-insulating cover 70 and the sound-absorbing material 81 are applied, the compressor 64 is not overheated as compared to an existing compressor.

The clothes dryer of the present invention has an effect of reducing the noise emanating through the ventilation slots.

Secondly, it is possible to maintain the cooling performance of the compressor constituting the heat pump at a level similar to that of the prior art by securing sufficient amount of inflow air through the ventilation part while reducing the noise. That is, it is possible to suppress heat generation of the compressor and reduce noise without deteriorating the performance of the clothes dryer.

Third, there is an effect of absorbing or reducing the high frequency noise generated when the compressor operates.

Fourth, even when a sound absorbing material is installed, it is possible to secure sufficient flow rate of the outside air flowing through the ventilation part.

What is claimed is:

1. A clothes dryer, comprising:

a casing having an inner space, and a ventilation part for allowing the inner space to communicate with an external space;

a drum disposed in the casing on a circulation flow path;

a heat pump with a compressor for circulating a refrigerant along a refrigerant pipe, the heat pump absorbing heat from air discharged from the drum during circulation of the refrigerant, and heating, by using the absorbed heat, air to be supplied into the drum along the circulation flow path;

a cooling fan, which is disposed in the casing, for cooling the compressor by introducing outside air into the casing through the ventilation part;

a sound-insulating cover which is connected with the casing and spaced apart from the ventilation part so that the outside air is introduced into the casing through the ventilation part, the sound-insulating cover comprising a sound-insulating plate which is disposed to overlap with at least a portion of the ventilation part when looking at the ventilation part from the rear of the dryer, and a sound-absorbing material which is fixed at the sound-insulating cover, so as to be disposed between the sound-insulating plate and the ventilation part.

2. The clothes dryer of claim 1, wherein the sound-insulating cover further comprises a sound-insulating plate supporter which extends from the sound-insulating plate toward the casing to be connected with the casing, so that the sound-insulating plate is fixed at a position spaced apart from the ventilation part.

3. The clothes dryer of claim 2, wherein the sound-insulating plate supporter comprises a supporting part extending a predetermined length from the sound-insulating plate to the casing to define space between the sound-insulating plate and the casing, and a connection part which is bent from the supporting part to be disposed side by side with one surface of the casing having the ventilation part.

4. The clothes dryer of claim 1, wherein:

the sound-insulating plate has at least one air passage opening for outside air, in a region where the sound-insulating plate overlaps with the ventilation part; and the sound-absorbing material is fixed below the air passage opening.

5. The clothes dryer of claim 4, wherein the sound-insulating cover further comprises at least one hook which protrudes from one surface of the sound-insulating plate that faces the ventilation part, and fixes the sound-absorbing material.

6. The clothes dryer of claim 5, wherein:

the at least one hook comprises a horizontal part which extends horizontally from the sound-insulating plate toward the ventilation part, and a vertical part which is bent from the horizontal part to extend downward; and the sound-absorbing material is interposed between the vertical part and the sound-insulating plate.

7. The clothes dryer of claim 6, wherein the sound-insulating plate has a first through-hole, wherein when viewed from a front side of the first through-hole, an entire vertical part of the hook is viewed through the first through-hole.

8. The clothes dryer of claim 1, wherein the sound-insulating plate comprises:

a flat plate part which has one surface facing the ventilation part; and a side part which is bent from a circumference of the flat plate part and extends toward the ventilation part, wherein the sound-absorbing material is made of a porous material and is disposed in a concave space formed by the flat plate part and the side part.

9. The clothes dryer of claim 8, wherein the sound-insulating cover further comprises a horizontal fixing tap which protrudes from the side part in a transverse direction, wherein the sound-absorbing material is fixed between the horizontal fixing tap and the flat plate part.

10. The clothes dryer of claim 9, the sound-insulating cover has a second through-hole which is formed to enable an entire horizontal fixing tap to be viewed through the second through-hole when viewed from a rear of the sound-insulating plate.

11. The clothes dryer of claim 8, wherein the sound-insulating cover further comprises one or more vertical fixing tap which protrudes upward from the side part, wherein the sound-absorbing material is fixed between the one or more vertical fixing tap and the flat plate part.

12. The clothes dryer of claim 1, wherein the sound-insulating plate comprises at least one air passage opening for outside air, in a region where the sound-insulating plate overlaps with the ventilation part.

13. The clothes dryer of claim 1, wherein the sound-insulating plate comprises at least one air passage opening for outside air, in a region where the sound-insulating plate overlaps with the ventilation part, wherein a total area, obtained by adding a first outside air inlet area, formed between an outer circumference portion of the sound-insulating plate and the casing, and an area of the at least one air passage opening, is twice to 2.5 times a second outside air inlet area formed by the ventilation part.

* * * * *